US006635171B2

(12) United States Patent
Rosenbaum et al.

(10) Patent No.: US 6,635,171 B2
(45) Date of Patent: Oct. 21, 2003

(54) PROCESS FOR UPGRADING OF FISCHER-TROPSCH PRODUCTS

(75) Inventors: John M. Rosenbaum, Richmond, CA (US); Christopher A. Simmons, El Cerrito, CA (US); Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/758,750

(22) Filed: Jan. 11, 2001

(65) Prior Publication Data

US 2002/0128331 A1 Sep. 12, 2002

(51) Int. Cl.[7] ..... C10G 17/00; C10G 73/06; C10G 25/00; C10G 29/00

(52) U.S. Cl. ..... 208/213; 208/31; 208/208 R; 208/254 R; 208/244; 208/245; 208/251 R; 208/254 H; 585/820; 585/821

(58) Field of Search ..... 208/254 R, 254 H, 208/244, 245, 31, 208 R, 213, 251 R; 585/820, 821

(56) References Cited

U.S. PATENT DOCUMENTS

| | | | | |
|---|---|---|---|---|
| 3,666,660 | A | 5/1972 | Bernheimer | |
| 3,852,207 | A | 12/1974 | Stangeland et al. | |
| 3,904,513 | A | 9/1975 | Fischer et al. | |
| 4,018,562 | A | 4/1977 | Parks et al. | |
| 4,137,154 | A | 1/1979 | Audeh | |
| 4,157,294 | A | 6/1979 | Iwao et al. | |
| 4,351,801 | A | 9/1982 | Bartke | |
| 4,401,556 | A | 8/1983 | Bezman et al. | |
| 4,657,661 | A | 4/1987 | Miller | |
| 4,820,402 | A | 4/1989 | Partridge et al. | |
| 4,913,799 | A | 4/1990 | Gortsema et al. | |
| 4,943,672 | A | 7/1990 | Hammer et al. | 58/737 |
| 5,059,567 | A | 10/1991 | Linsten et al. | |
| 5,073,530 | A | 12/1991 | Bezman et al. | |
| 5,076,909 | A | 12/1991 | Overfield et al. | |
| 5,109,139 | A | 4/1992 | Dickson et al. | |
| 5,114,563 | A | 5/1992 | Lok et al. | |
| 5,158,665 | A | 10/1992 | Miller | |
| 5,198,203 | A | 3/1993 | Kresge et al. | |
| 5,246,689 | A | 9/1993 | Beck et al. | |
| 5,334,368 | A | 8/1994 | Beck et al. | |
| 5,612,225 | A | 3/1997 | Baccanti et al. | |
| 5,993,664 | A | 11/1999 | Streil et al. | |
| 6,005,150 | A | 12/1999 | Vora | |
| 6,103,099 | A | 8/2000 | Wittenbrink et al. | |
| 6,147,126 | A | 11/2000 | DeGeorge et al. | |
| 6,156,947 | A * | 12/2000 | Vora | 585/324 |
| 6,225,359 | B1 * | 5/2001 | O'Rear et al | 518/706 |

FOREIGN PATENT DOCUMENTS

| | | | |
|---|---|---|---|
| EP | 0471524 | A1 * | 2/1992 |
| EP | 0 583 836 | A1 | 8/1993 |
| EP | 0 668 342 | A1 | 2/1995 |
| EP | 0799882 | A1 | 10/1997 |
| WO | WO-99/41335 | A1 | 8/1999 |
| WO | WO-00/58420 | A1 | 10/2000 |

OTHER PUBLICATIONS

Day, D., "A Suggestion as to the Origin of Pennsylvania Petroleum," *Proceedings of the American Philosophical Society*36:; 112–115 (1897).

Gruse, W., and Stevens, D., *Chemical Technology of Petroleum*, 3rd edition: pp. 331–333 (1960) McGraw Hill Book Company, Inc., New York.

* cited by examiner

*Primary Examiner*—J. Parsa
(74) *Attorney, Agent, or Firm*—Burns, Doane, Swecker & Mathis, L.L.P.

(57) ABSTRACT

A process for treating nitrogen-containing, substantially paraffinic product derived from a Fischer-Tropsch process. The substantially paraffinic product is purified in a purification process to lower the concentration of oxygen, nitrogen, and other impurities. The nitrogen content of the purified product is monitored, and the conditions of the purification step are adjusted to increase nitrogen removal if the nitrogen content of the purified product exceeds a preselected value.

9 Claims, No Drawings

PROCESS FOR UPGRADING OF FISCHER-TROPSCH PRODUCTS

The present invention relates to a process for upgrading nitrogen-containing Fischer-Tropsch products.

BACKGROUND OF THE INVENTION

Fischer-Tropsch products can be upgraded before being sold as products. The usual processes that are used are hydrocracking to make distillate fuels such as diesel and jet fuel, naphtha, and feeds for lube processing. These products can also be upgraded by wax isomerization to make lube base oils. Finally, the light naphtha can be reformed to make aromatics for use in gasoline or petrochemicals.

Several catalysts used in these upgrading processes require low levels of heteroatoms for efficient operation. The key heteroatoms that must be controlled to low levels are nitrogen and oxygen. Nitrogen is the most serious catalyst poison, while oxygen is a lesser concern. The presence of nitrogen-containing impurities in a feedstock causes the reactions to be performed at higher than desired hydroprocessing reactor temperatures, with a serious reduction in the yield of valuable products.

Products from Fischer-Tropsch synthesis are well known to contain oxygen impurities and have little or no sulfur. It was unknown that Fischer-Tropsch products can contain nitrogen. If oxygen is the only impurity to be considered, the upgrading can be quite mild, as described in EP 583 836 B1 and EP 668 342 A1. These patents speak of "mild hydrogenation, under conditions such that substantially no isomerization or hydrocracking of hydrocarbons occurs" (lines 50–55 in 583 836 B1). These mild conditions typically remove sulfur and oxygen impurities, but not nitrogen impurities. Likewise, U.S. Pat. No. 4,943,672 describes severe hydrotreating to improve the processing of Fischer-Tropsch wax, but states that Fischer-Tropsch wax contains essentially no nitrogen or sulfur.

SUMMARY OF THE INVENTION

We have discovered that some Fischer-Tropsch waxes and products can contain nitrogen, and it is advantageous to reduce the nitrogen content of these products below a threshold value. When Fischer-Tropsch products contain nitrogen, the mild hydrotreating conditions used in the prior art can be insufficient to reduce the nitrogen to an effective low level. For best (or at least, satisfactory) operation in Fischer-Tropsch wax and condensate upgrading processes, the nitrogen content must be below 15 ppm, preferably below 5 ppm, and most preferably below 1 ppm.

The present invention provides a process for treating nitrogen-containing, substantially paraffinic products derived from a Fischer-Tropsch process. That process comprises three steps: a purification step, a monitoring step, and an adjustment step. In the purification step, the substantially paraffinic product,is purified in a purification process to remove oxygen, nitrogen, and other impurities. Then, in the monitoring step, the nitrogen content (and other impurities) of the reduced product is monitored. Finally, in the adjustment step, the conditions of the purification step are adjusted to increase nitrogen removal if the nitrogen content of the reduced product exceeds a preselected value. If the nitrogen content of the reduced product does not exceed the preselected value, no adjustment is necessary.

The nitrogen reduction can be achieved by a number of methods, including hydrotreating, adsorption and extraction.

DETAILED DESCRIPTION OF THE INVENTION

In its broadest aspect, the present invention involves the discovery that some Fischer-Tropsch waxes and other products can contain nitrogen, and it is advantageous to reduce the nitrogen content of these products below a preselected threshold value.

As used herein, the following terms have the following meanings unless expressly stated to the contrary:

The term "substantially paraffinic product" refers to a product comprising at least 50% paraffins.

The term "nitrogen-containing, substantially paraffinic product" refers to a product comprising at least 50% paraffins and at least 1 ppm nitrogen.

The term "nitrogen-containing, substantially paraffinic product of a Fischer-Tropsch process" refers to a product of a Fischer-Tropsch process, wherein that product comprises at least 50% paraffins and at least 1 ppm nitrogen.

Unless otherwise specified, all percentages are in weight percent and all parts per million (ppm) are by weight.

As defined above, the "nitrogen-containing, substantially paraffinic product of a Fischer-Tropsch process" refers to a product produced by a Fischer-Tropsch process comprising at least 50% paraffins and at least 1 ppm nitrogen.

Our invention is based on the surprising discovery that some Fischer-Tropsch products have too much nitrogen for use in some catalystic processes. It is not known exactly why some Fischer-Tropsch products have too much nitrogen and other Fischer-Tropsch products do not. It may be related to a combination of catalyst and reactor system.

In Fischer-Tropsch chemistry, syngas is converted to liquid hydrocarbons by contact with a Fischer-Tropsch catalyst under reactive conditions. Fischer-Tropsch synthesis may be effected in a fixed bed, in a slurry bed, or in a fluidized bed reactor. The Fischer-Tropsch reaction conditions may include using a reaction temperature of between 190 C. and 340 C., with the actual reaction temperature being largely determined by the reactor configuration. Thus, when a fluidized bed reactor is used, the reaction temperature is preferably between 300 C. and 340 C.; when a fixed bed reactor is used, the reaction temperature is preferably between 200 C. and 250 C.; and when a slurry bed reactor is used, the reaction temperature is preferably between 190 C. and 270 C.

An inlet synthesis gas pressure to the Fischer-Tropsch reactor of between 1 and 50 bar, preferably between 15 and 50 bar, may be used. The synthesis gas may have a $H_2$:CO molar ratio, in the fresh feed, of 1.5:1 to 2.5:1, preferably 1.8:1 to 2.2:1. The synthesis gas typically includes 0.1 wppm of sulfur or less. A gas recycle may optionally be employed to the reaction stage, and the ratio of the gas recycle rate to the fresh synthesis gas feed rate, on a molar basis, may then be between 1:1 and 3:1, preferably between 1.5:1 and 2.5:1. A space velocity, in $m^3$ (kg catalyst)$^{-1}$ hour$^{-1}$, of from 1 to 20, preferably from 8 to 12, may be used in the reaction stage.

In principle, an iron-based, a cobalt-based or an iron/cobalt-based Fischer-Tropsch catalyst can be used in the Fischer-Tropsch reaction stage. The iron-based Fischer-Tropsch catalyst may include iron and/or iron oxides which have been precipitated or fused. However, iron and/or iron oxides which have been sintered, cemented, or impregnated onto a suitable support can also be used. The iron should be reduced to metallic Fe before the Fischer-Tropsch synthesis. The iron-based catalyst may contain various levels of promoters, the role of which may be to alter one or more of the activity, the stability, and the selectivity of the final catalyst.

Preferred promoters are those influencing the surface area of the reduced iron ("structural promoters"), and these include oxides or metals of Mn, Ti, Mg, Cr, Ca, Si, Al, or Cu or combinations thereof.

The nitrogen-containing, substantially paraffinic product of a Fischer-Tropsch process is purified in a purification zone (e.g., hydrotreated in a hydrotreating zone) to remove nitrogen, oxygen and other impurities to form a treated waxy heavy fraction. Such hydrotreating zones are well known in the industry. Other treatments useful for removing nitrogen, oxygen and other impurities include, but are not limited to, adsorption (e.g., with an acid clay) and extraction.

Hydrogenation catalysts can be used for the purification. For example, a noble metal from Group VIIIA according to the 1975, rules of the International Union of Pure and Applied Chemistry, such as platinum or palladium on an alumina or siliceous matrix, or unsulfided Group VIIIA and Group VIB, such as nickel-molybdenum or nickel-tin on an alumina or siliceous matrix, is a suitable catalyst. U.S. Pat. No. 3,852,207 to Stangeland et al. ("Production of Stable Lubricating Oils By Sequential Hydrocracking and Hydrogenation") describes a suitable noble metal catalyst and mild conditions. Other suitable catalysts are detailed, for example, in U.S. Pat. No. 4,157,294 to Iwao, et al. ("Method of Preparing Base Stocks For Lubricating Oil"), and U.S. Pat. No. 3,904,513 to Fischer et al. ("Hydrofinishing or Petroleum"). The non-noble metal (such as nickel-molybdenum) hydrogenation metal are usually present in the final catalyst composition as oxides, or more preferably or possibly, as sulfides when such compounds are readily formed from the particular metal involved. Preferred non-noble metal overall catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts contain in excess of 0.01% metal, preferably between 0.1 and 1.0% metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e., molybdenum and tungsten can be combined with the refractory oxide by impregnation, co-mulling or co-precipitation. Although these components can be combined with the catalyst matrix as the sulfides, that is generally not the case. They are usually added as a metal salt, which can be thermally converted to the corresponding oxide in an oxidizing atmosphere or reduced to the metal with hydrogen or other reducing agent. If necessary, the non-noble metal composition can then be sulfided by reaction with a sulfur donor such as carbon bisulfide, hydrogen sulfide, hydrocarbon thiols, elemental sulfur, and the like.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so called ultra stable zeolite Y and high structural silica:alumina ratio zeolite Y such as for example described in U.S. Pat. No. 4,401,556 to Bezman, et al. ("Midbarrel Hydrocracking"), U.S. Pat. No. 4,820,402 to Partridge, et al., ("Hydrocracking Process With Improved Distillate Selectivity With High Silica Large Pore Zeolites"), and U.S. Pat. No. 5,059,567 to Listen, et al. ("Process For The Preparation of A Modified Zeolite"). Small crystal size zeolite Y, such as described in U.S. Pat. No. 5,073,530 to Bezman, et al. ("Hydrocracking Catalyst And Process") can also be used. Non-zeolitic molecular sieves which can be used include, for example silicoaluminophosphates (SAPO), ferroaluminophosphate, titanium aluminophosphate and the various ELAPO molecular sieves described in U.S. Pat. No. 4,913,799 to Gortsema, et al. ("Hydrocracking Catalysts And Processes Employing Non-Zeolitic Molecular Sieves") and the references cited therein. Details regarding the preparation of various non-zeolite molecular sieves can be found in U.S. Pat. No. 5,114,563 to Lok, et al. ("Hydrocarbon Conversions Using Catalysts Silicoaluminophosphates"); and in U.S. Pat. No. 4,913,799. Mesoporous molecular sieves can also be included, for example the M41S family of materials, MCM-41 (U.S. Pat. No. 5,246,689 to Beck, et al. ("Synthetic Porous Crystalline Material Its Synthesis And Use"), U.S. Pat. No. 5,198,203 to Kresge, et al. ("Synthetic Mesoporous Crystalline Material"), and U.S. Pat. No. 5,334,368 to Beck, et al. ("Synthesis of Mesoporous Oxide")), and MCM-48.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides naturally occurring clays which can be composited with the catalyst include those of the montmorillonite and kaolin families. These clays can be used in the raw state as originally mined or initially subjected to calumniation, acid treatment, or chemical modification.

Furthermore more than one catalyst type may be used in the reactor. The different catalyst types can be separated into layers or mixed.

Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300 F to about 750 F, preferably ranging from 450 F to 600 F.

U.S. Pat. Nos. 3,852,207; 3,904,513; 4,157,294; 4,401,556; 4,820,402; 4,913,799; 5,059,567; 5,073,530; 5,114,563; 5,198,203; 5,246,689; and 5,334,368 are hereby incorporated by reference for all purposes.

An adsorption step may be employed to remove nitrogenous species from the product. Suitable adsorbents to remove the nitrogen compounds include heterogeneous acid materials such as acidic clays, molecular sieves, and ion exchange resins. Such materials are described in U.S. Pat. No. 4,657,661 to Miller ("Process For Improving The Storage Stability And Bulk Oxidation Stability Of Lube Base Stocks Derived From Bright Stock"), hereby incorporated by reference for all purposes. Bauxite and/or alumina can also be used.

The refining of hydrocarbon steams in the lube base oil boiling range by adsorption has been known for over a century. It is described by William A. Gruse and Donald R. Stevens in Chemical Technology of Petroleum, 3$^{rd}$ edition, McGraw Hill Book Company, Inc, New York 1960. An earlier description of the separation of petroleum fractions on percolation through an adsorbent was by Day (Proc. Am.

Phil. Soc., 36:112 (1897)). Since then, many others have observed this behavior.

An extraction step may be employed to remove nitrogenous species from the feed. The use of solvents to selectively extract nitrogen compounds from hydrocarbons in the lube base oil boiling has been known for decades. For example by William A. Gruse and Donald R. Stevens in Chemical Technology of Petroleum, 3rd edition, McGraw Hill Book Company, Inc, New York 1960, describe on page 332 that nitrogen compounds will be dissolved preferentially in many common solvents: phenol, furfural, nitrobenzene, sulfur dioxide, etc. Phenol and furfural are used more commonly. Today, N-methylpyrrolidone is often used. However since this solvent contains nitrogen, more care than ususal must be taken to assure that the raffinate from the process is adequately stripped of N-methylpyrrolidone.

Any number of commercially available techniques based on chemiluminescence or gas chromatography may monitor the nitrogen content of the treated Fischer Tropsch product (and the feedstock to the purification step). Commercial analyzers based on chemiluminescence and associated equipment are sold by Antek Instruments, Inc. (Houston, Tex.) and are described in the following patents: U.S. Pat. No. 4,018,562 to Parks et al. ("Chemiluminescent Nitrogen Detection Apparatus and Method") and U.S. Pat. No. 4,351,801 to Bartke ("Combustion Apparatus For Use In Elementary Analysis"). Similarly, Fisons Instruments S.p.A. (Milan, IT) supplies analyzers based on chromatography. Their instruments are described in U.S. Pat. No. 5,612,225 to Bacanti et al. ("Process and Apparatus for Determining Total Nitrogen Content by Elemental Analysis"). U.S. Pat. Nos. 4,018,562; 4,351,801; and 5,612,225 are hereby incorporated by reference for all purposes.

The nitrogen monitoring can be done continuously or periodically. Preferably, the sample is melted prior to injection into the monitoring apparatus.

As the nitrogen content of the product from the purification step changes, the conditions of the treating step may need to be adjusted to maintain the nitrogen content in an acceptable range. The method of adjustment depends on the particular purification method.

If the nitrogen content of the purified product increases, the severity of the hydrotreating step must be increased to compensate for this increase. There are several ways to increase the hydrotreating severity:

1. Increase the catalyst temperature;
2. Decrease the LHSV of the oil processed over the catalyst;
3. Increase the pressure in the hydrotreating unit; or
4. Regenerate or change the catalyst to replace it with a new supply or a more active catalyst.

In general, the simplest method is to increase the catalyst temperature. Decreasing the LHSV would likely require a reduction in plant capacity. While this is not desirable, under some circumstances (e.g., a catalyst near its end of life), decreasing the LHSV may be selected. Increasing the pressure can only be done without equipment modifications if the unit were designed with the intention of operating at higher pressure. Regenerating or changing the catalyst is typically done when other approaches fail, or when the original catalyst is spent.

If the nitrogen content of the purified product increases, the operation of the adsorption step must be changed to compensate for this increase. Typically, there are only two approaches that can be used:

1. Regenerate or change the adsorbent to replace it with a new supply;
2. Decrease the LHSV of the material processed over the adsorbent.

Typically, adsorption systems operate at a constant LHSV. When the product nitrogen increases beyond the desired value, the adsorbent is regenerated. Typical methods of regeneration include washing with a solvent or burning with air or some other inexpensive oxidant (or combinations of solvent washing and burning).

If the nitrogen content of the purified product increases, the conditions of the extraction step must be changed to compensate for this increase. There are several ways to increase the adjust the conditions of the extraction step to compensate for higher nitrogen products:

5. Increase the raffinate stripping severity if a nitrogen-containing solvent like N-methylpyrrolidone is used in the extraction;
6. Increase the ratio of solvent to Fischer-Tropsch products;
7. Adjust the solvency of the solvent (typically changing the water content or changing the amount of co-solvent, for example, as used in phenol-cresol mixed solvents);
8. Increase the contacting efficiency (e.g., by increasing the stirring speed);
9. Increase the residence time in the extractor.

If a nitrogen-containing solvent is used, and the raffinate stripping is not adequate, this adjustment may be made first. Otherwise, the most common methods of adjustment are to increase the solvent to oil ratio, and/or to adjust the solvency of the solvent and/or to increase the contacting efficiency. Increasing the residence time in the extractor is typically used as a last method of choice since it will decrease the capacity of the plant. However, under some circumstances it may be desirable to use this method.

EXAMPLES

The invention will be further illustrated by following examples, which set forth particularly advantageous method embodiments. While the Examples are provided to illustrate the present invention, they are not intended to limit it.

Example One

Three relatively low nitrogen waxy Fischer Tropsch products were prepared at different viscosities.

| Viscosity Target | 4 cSt @ 100° C. | 8 cSt @ 100° C. | 25 cSt BS @ 100° C. |
|---|---|---|---|
| Nitrogen, ppm | 2.18 | 10.50 | 10.80 |
| Vis @ 150 C., cSt | | | 10.37 |
| Vis @ 135 C., cSt | 2.37 | 4.73 | 12.99 |
| Vis @ 100 C., cSt | 3.80 | | |

Example Two

Three relatively higher nitrogen-content waxy Fischer Tropsch products were also prepared at approximately the same viscosity targets as used in Example One.

| Viscosity Target | 4 cSt @ 100° C. | 8 cSt @ 100° C. | 25 cSt BS @ 100° C. |
|---|---|---|---|
| Nitrogen, ppm | 5.58, 5.60 | 19.94, 22.74 | 58.71 |
| Vis @ 135 C., cSt | 2.48 | 5.22 | 10.08 |
| Vis @ 100 C., cSt | 4.01 | 8.41 | 21.22 |

When the viscosity target was 8 cSt @ 100 C., the oxygen content was 0.73%. The Group Type Analysis of that sample by GC-MS was 69.5% n-alkanes, 4.1% alkenes, 11.8% alcohols, 3.7% acids, and the balance (10.9%) was primarily iso-alkanes. The GC-MS technique used a commercial instrument (model HP-5970) from Hewlett Packard. The alcohols and acids in the sample were converted into derivatives to facilitate analysis by using a silylating reagent from Pierce Chemical.

Example Three

The three relatively low-nitrogen Fischer Tropsch products and the three relatively high-nitrogen Fischer Tropsch products were subjected to catalytic hydroisomerization to reduce their pour and cloud points using a Pt on alumina bound SAPO-11 catalyst prepared according to U.S. Pat. Nos. 5,158,665 and 5,993,664. A second reactor contained a Group VIII hydrofinishing catalyst prepared according to Example 4 of U.S. Pat. No. 5,993,664. The conditions of these experiments were:

| | |
|---|---|
| LHSV (Isodewaxing) | 0.4 $hr^{-1}$ |
| LHSV (Hydrofinishing) | 1.0 $hr^{-1}$ |
| $H_2$ Partial Pressure | 1000 psia |
| Recycle $H_2$ gas rate | 5000 SCFB |

The products were distilled to generate materials in the desired lube viscosity ranges. The catalyst temperature was adjusted to achieve the desired pour point in the distilled product. The following results were obtained.

| Viscosity Target | 4 cSt | 4 cSt | 8 cSt | 8 cSt | 25 cSt | 25 cSt |
|---|---|---|---|---|---|---|
| Feed Viscosity @ 100 C., cSt | 3.80 | 4.00 | N/A | 8.41 | N/A | 21.22 |
| Feed Viscosity @ 135 C., cSt | 2.37 | 2.48 | 4.73 | 5.22 | 12.99 | 10.08 |
| Feed Nitrogen, ppm | 2.2 | 5.6 | 11 | 21 | 11 | 59 |
| Dewaxing Catalyst Temp., F. | 675 | 692 | 675 | 712 | 695 | 734 |
| Lube Base Oil Yield, Wt % | 55 | 22 | 45 | 30 | 19 | 13 |
| Lube Properties: | | | | | | |
| Lube Viscosity @ 100 C., cSt | 4.16 | 4.06 | 8.12 | 8.01 | 26.3 | 25.7 |
| Pour Point, C. | −15 | −16 | −21 | −21 | −10 | −12 |

As can be seen for each feedstock viscosity range and at essentially equivalent product pour points, the lower nitrogen feed is both easier to convert (required lower catalyst temperatures) and gives significantly higher yields of lube products.

Example Four

In this example and the next, the nitrogen content of a Fischer Tropsch feedstock was reduced and the performance was enhanced.

The high nitrogen feedstock from the 8 cSt operation of Example Two was hydrotreated to remove the nitrogen. The commercial lube hydrofinishing catalyst used in Example Three was used in two passes. The product gases (including ammonia) were stripped from the product. The conditions and yields are shown below.

| | First Pass HDT | Second Pass HDT |
|---|---|---|
| Catalyst Temperature, ° F. | 650 | 670 |
| Catalyst LHSV | 0.98 | 1.02 |
| Total Pressure, psig | 1097 | 1096 |
| H2 AVG. press., psia | 973 | 1041 |
| Total Gas in, SCF/B | 5165 | 5097 |
| Recycle Gas, SCF/B | 4977 | 5027 |
| No Loss Product Yields | WT % | WT % |
| Total C5+ | 99.45 | 99.96 |
| Diesel Yield, 290–700 F., wt % | 1.87 | 1.00 |
| 650 F. +, wt % | 98.09 | 99.52 |
| Stripped Product Properties: | | |
| Nitrogen, ppm | 14.6 | 5.645 |

These conditions reduced the nitrogen content from its initial value of approximately 21 ppm.

Conversion to lighter species was very small (less than 2 wt%).

During the first pass described above, the product oxygen was measured to be 0.33. During this first pass, the oxygen conversion was 55% while the nitrogen conversion was only 31%. The Group Type Analysis of the first pass by GC-MS was 87.9% n-alkanes, 0% alkenes, 0% alcohols, 0.6% acids, and the balance (11.5%) was primarily iso-alkanes. The first pass hydrotreating completely removed olefins and alcohols. Thus, a process designed to remove oxygen, olefin and alcohol impurities will not necessarily remove sufficient quantities of the nitrogen impurities.

Example Five

The second pass of Example Four was dewaxed under conditions comparable to those used on the original feedstock in Example Three.

| Feed ID | Ex. 3 | Ex. 4 | Ex. 4 |
|---|---|---|---|
| Pretreatment | None | Denitrification | Denitrification |
| Feedstock Nitrogen, ppm | 19.94, 22.74 | 5.645 | 5.645 |
| Dewaxing Catalyst Temp., F. | 710 | 693 | 693 |
| Hydrofinishing Catalyst Temp., F. | 450 | 450 | 450 |
| Dewaxing Catalyst LHSV | 0.4 | 0.39 | 0.41 |
| Hydrofinishing Catalyst LHSV | 1.0 | 0.98 | 1.015 |
| H2 AVG. press., psia | 1000 | 1072 | 1063 |
| Recycle Gas, SCF/B | 5000 | 5077 | 4902 |
| No Loss Product Yields | | WT % | WT % |
| Total C5+ | | 98.73 | 98.85 |
| Diesel Yield, 290–700 F., wt % | | 28.69 | 27.36 |

-continued

| Feed ID | Ex. 3 | Ex. 4 | Ex. 4 |
|---|---|---|---|
| 650 F. +, wt % | | 69.94 | 71.43 |
| Lube Base Oil Yield, Overall, including HDT, wt % | 30 | 48.5 | 52.1 |
| Lube Base Oil Properties: | | | |
| Pour, C. | −21 | −21 | −18 |
| Lube Viscosity @ 100 C., cSt | 8.01 | 7.933 | 7.905 |

Hydrotreating the feed to remove nitrogen significantly improves its activity (17 F) and improves lube yields (approximately 20%)—comparisons made at essentially the same product viscosity and pour point.

While the present invention has been described with reference to specific embodiments, this application is intended to cover those various changes and substitutions that may be made by those skilled in the art without departing from the spirit and scope of the appended claims.

What is claimed is:

1. A process for treating a nitrogen-containing, substantially paraffinic product from a Fischer-Tropsch process, said process comprising:

(a) deriving a substantially paraffinic product from a Fischer Tropsch process wherein said substantially paraffinic product initially contains more than 15 ppm nitrogen;

(b) selecting a nitrogen level for the substantially paraffinic product from the Fischer Tropsch process;

(c) purifying the substantially paraffinic product in a purification process to remove oxygen, nitrogen, and other impurities;

(d) monitoring the nitrogen content of the purified product;

(e) adjusting the conditions of the purification step (a) to increase nitrogen removal if the nitrogen content of the purified product exceeds the selected nitrogen level; and (f) upgrading the purified product.

2. A process for treating a nitrogen-containing, substantially paraffinic product according to claim 1, wherein said preselected value is no more than 15 ppm.

3. A process for treating a nitrogen-containing, substantially paraffinic product according to claim 2, wherein said preselected value is no more than 5 ppm.

4. A process for treating a nitrogen-containing, substantially paraffinic product according to claim 3, wherein said preselected value is no more than 1 ppm.

5. A process for treating a nitrogen-containing, substantially paraffinic product according to claim 1, wherein said purification process comprises hydrotreating.

6. A process for treating a nitrogen-containing, substantially paraffinic product according to claim 1, wherein said purification process comprises adsorption.

7. A process f treating a nitrogen-containing, substantially paraffinic product according to claim 1, wherein said purification process comprises extraction.

8. A process for treating a nitrogen-containing, substantially paraffinic product according to claim 1, wherein said upgrading process comprises wax isomerization to provide a lube base oil.

9. A process for treating a nitrogen-containing, substantially paraffinic product according to claim 6, wherein said upgrading process comprises reformation of light naphtha to provide aromatics.

* * * * *

UNITED STATES PATENT AND TRADEMARK OFFICE

CERTIFICATE OF CORRECTION

PATENT NO. : 6,635,171 B2
DATED : October 21, 2003
INVENTOR(S) : Rosenbaum et al.

It is certified that error appears in the above-identified patent and that said Letters Patent is hereby corrected as shown below:

Column 10,
Line 23, please delete the letter "f", and insert therefor -- for --.

Signed and Sealed this

Sixteenth Day of December, 2003

JAMES E. ROGAN
*Director of the United States Patent and Trademark Office*